US009551976B2

(12) United States Patent
Stranczl et al.

(10) Patent No.: US 9,551,976 B2
(45) Date of Patent: Jan. 24, 2017

(54) PALLET LEVER FOR A TIMEPIECE ESCAPEMENT MECHANISM

(71) Applicant: Nivarox-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/759,056

(22) PCT Filed: Mar. 6, 2014

(86) PCT No.: PCT/EP2014/054370

§ 371 (c)(1),
(2) Date: Jul. 2, 2015

(87) PCT Pub. No.: WO2014/146908

PCT Pub. Date: Sep. 25, 2014

(65) Prior Publication Data

US 2015/0355599 A1 Dec. 10, 2015

(30) Foreign Application Priority Data

Mar. 19, 2013 (EP) ..... 13160030

(51) Int. Cl.
*G04B 15/00* (2006.01)
*G04B 29/00* (2006.01)
(Continued)

(52) U.S. Cl.
CPC ..... *G04B 15/14* (2013.01); *G04B 15/00* (2013.01); *G04B 29/00* (2013.01); *G04B 29/02* (2013.01);
(Continued)

(58) Field of Classification Search
CPC ..... G04B 15/00; G04B 15/08; G04B 29/00; G04B 29/02; G04B 29/022; G04B 29/027; G04B 29/04
(Continued)

(56) References Cited

U.S. PATENT DOCUMENTS 2,647,362 A * 8/1953 Fidelman ..... G04B 15/08 368/186
2,663,139 A * 12/1953 Fink ..... G04B 15/08 368/132
(Continued)

FOREIGN PATENT DOCUMENTS

CH 703333 A2 * 12/2011 ..... G04B 15/08
EP 2 605 079 A1 6/2013
(Continued)

OTHER PUBLICATIONS

International Search Report issued Jun. 26, 2014, in PCT/EP2014/054370, filed Mar. 6, 2014.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

An intermittent blocking mechanism for at least one escape wheel, that intermittent blocking mechanism cooperating with at least one regulating member or a balance which is actuated with an alternate motion under action of an elastic return mechanism, the intermittent blocking mechanism being pivoted in at least one bottom plate, and forming an inseparable single-piece component with the bottom plate. The intermittent blocking mechanism includes at least one pallet lever in a single-piece with the plate to which it is connected by the elastic return mechanism.

9 Claims, 2 Drawing Sheets

(51) Int. Cl.
*G04B 15/14* (2006.01)
*G04B 29/02* (2006.01)
*G04B 29/04* (2006.01)

(52) U.S. Cl.
CPC ..... *G04B 29/022* (2013.01); *G04B 29/027* (2013.01); *G04B 29/04* (2013.01)

(58) Field of Classification Search
USPC ..... 368/124, 127, 131–133, 318, 324
See application file for complete search history.

(56) References Cited

U.S. PATENT DOCUMENTS

| | | | | |
|---|---|---|---|---|
| 2,968,186 | A * | 1/1961 | Jeanneret | G04B 15/00 368/125 |
| 3,731,480 | A * | 5/1973 | Kurita | G04B 15/14 368/125 |
| 2007/0147180 | A1* | 6/2007 | Rufenacht | G04B 29/022 368/184 |
| 2009/0081476 | A1* | 3/2009 | Saucy | G04B 29/027 428/614 |
| 2010/0108697 | A1* | 5/2010 | Cadau | G04D 1/066 220/632 |
| 2013/0051190 | A1* | 2/2013 | Villar | G04B 29/022 368/132 |
| 2013/0070570 | A1* | 3/2013 | Colpo | G04B 15/06 368/127 |
| 2014/0313869 | A1* | 10/2014 | Cattiau | G04B 37/0091 368/281 |

FOREIGN PATENT DOCUMENTS

| | | | |
|---|---|---|---|
| EP | 2 605 087 | A1 | 6/2013 |
| WO | WO 2011/120180 | A1 | 10/2011 |

* cited by examiner

PALLET LEVER FOR A TIMEPIECE ESCAPEMENT MECHANISM

CROSS-REFERENCE TO RELATED APPLICATIONS

This is a National Phase Application in the United States for International patent application PCT/EP2014/054370 filed Mar. 6, 2014 which claims priority on European patent application No. 13160030.6 filed Mar. 19, 2013. The entire disclosures of the above patent applications are hereby incorporated by reference.

FIELD OF THE INVENTION

The invention concerns a timepiece assembly including a bottom plate and a mechanism for the intermittent blocking of at least one escape wheel, said intermittent blocking mechanism cooperating with at least one regulating member or a balance which is arranged to be actuated with an alternate motion under the action of at least one balance spring or an alternate elastic return means, said intermittent blocking means being arranged to be pivoted in at least said bottom plate.

The invention also concerns an escapement mechanism including at least one such timepiece assembly.

The invention also concerns a mechanical timepiece movement including at least one such escapement mechanism.

The invention concerns the field of timepiece mechanisms, and more specifically movements integrating ready-to-use functional modules. The invention concerns, in particular, the distribution of energy in an escapement mechanism.

BACKGROUND OF THE INVENTION

The use of modular assemblies permits the manufacture of families of products using a common base, each personalised by different options or functions, notably complications in the case of a mechanical timepiece movement.

The concept of extremely high precision modules or cassettes allows large scale production to be combined with high quality goods.

Thus, modular sub-assemblies for timepiece movements are known, from EP Patent Application Nos 11193173.9 and 11193174.7 in the name of ETA SA. The mechanical modules disclosed in these Patent Applications are irreversibly pre-adjusted and assembled to ensure the durability of their settings.

However, in a conventional embodiment, the modules do not always make it possible to reduce the number of components, which could both reduce production costs and simplify the assembly plan, enabling mid-level technical personnel to assemble and adjust the most complex functions, which include the distribution of energy in an escapement mechanism.

WO Patent Application No 2011/120180 A1 in the name of ROLEX discloses a blocking mechanism for a toothed wheel, including a pallet lever, a main plate and elastic return means, which form a flat one-piece assembly, in the plane of an escape wheel.

SUMMARY OF THE INVENTION

Thus, the invention proposes to provide modules with a reduced number of components and of average assembly and adjustment complexity.

The present invention utilises, for this purpose, the new micro-component manufacturing technologies, MEMS, "LIGA", lithography and suchlike, to optimise the manufacture of the modules, shown here as cassettes. These cassettes may be irreversibly assembled to each other as in the above two Patent Applications, or positioned and assembled in a conventional manner.

The invention proposes to facilitate the simple integration, in a modular construction, of a mechanism for the intermittent blocking of an escapement mechanism, or of a complete escapement mechanism.

To this end, the invention concerns a timepiece assembly including a bottom plate and a mechanism for the intermittent blocking of at least one escape wheel, said intermittent blocking mechanism cooperating with at least one regulating member or a balance which is arranged to be actuated with an alternate motion under the action of at least one balance spring or an alternate elastic return means, said intermittent blocking means being arranged to be pivoted in at least one bottom plate, characterized in that said intermittent blocking mechanism forms an inseparable one-piece component with said bottom plate, which also forms a one-piece component with a first bearing for said escape wheel and with a second pivot bearing for said regulating member or of said balance, said first bearing and said second bearing being remote from a fixed distance between centres, and said intermittent blocking mechanism pivoting about a virtual axis whose theoretical position is defined with reference to the positions of said first bearing and said second bearing.

According to a characteristic of the invention, said intermittent blocking mechanism includes at least one pallet lever in one-piece with said plate to which the pallet lever is connected by elastic return means.

According to a characteristic of the invention, said pallet lever includes a top portion carrying pallet stones, horns and a dart, and which is added and secured to a bottom portion, which is in the plane of said plate to which said pallet lever is connected by elastic return means which are also in the plane of said plate.

The invention also concerns an escapement mechanism including at least one such timepiece assembly.

The invention also concerns a mechanical timepiece movement including at least one such escapement mechanism.

The advantage of making components in a single-piece, and in particular with the plate or the bars, is that the number of parts is reduced, and assembly problems are avoided. The invention benefits from the precision with which these one-piece components are made (typically, the parts are for example made of silicon and therefore enjoy micrometric precision).

The one-piece cassette has the main advantage of guaranteeing the distances between centres and of forming a ready-to-use mechanism, in particular an oscillator in a preferred application.

The invention incorporates, in particular, flexible guide members, which have the following advantages:

- guaranteed precision;
- very reduced or zero friction level;
- no hysteresis in the movements, due to the absence of friction or at least the extremely reduced level of friction;
- no lubrication;
- no play;
- no wear.

The fabrication of these flexible guide members results in limitations, notably a limited travel, low return forces, and a limited load. However, these limitations are not prohibitive for a number of horological functions, in particular those which relate to regulation.

These limitations are amply compensated by the high precision of the distance between centres, the small number of components to be made and hence the reduced complexity and assembly time. A cassette according to the invention has a great industrial advantage: the mechanism cassette, particularly an oscillator, forms a component ready for assembly in a movement. Further, there is nothing to prevent an entire movement being devised in the form of a cassette of the invention.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
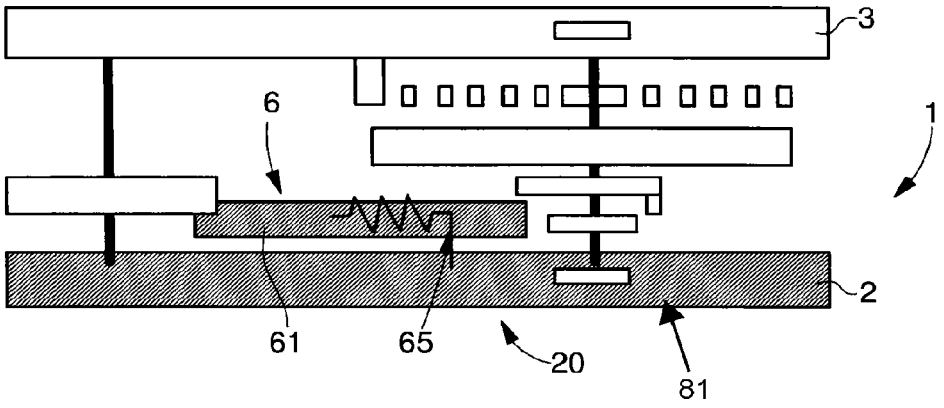
FIG. 1 shows a schematic, side view of an escapement mechanism according to the invention, which includes an intermittent blocking mechanism according to the invention including a pallet lever, arranged between a plate and a bar, and cooperating with an escape wheel on one side, and with a balance returned by a balance spring on the other side, and wherein the pallet lever is made in a one-piece manner with a plate to which the pallet lever is connected by integrated elastic return means.

The invention concerns the field of timepiece mechanisms, and more specifically movements integrating ready-to-use functional modules. The invention concerns, in particular, the distribution of energy in an escapement mechanism.

The invention concerns a mechanism 6 for the intermittent blocking of at least one escape wheel 5. This intermittent blocking mechanism cooperates with at least one regulating member 4 or a balance 41, which is actuated by an alternate motion under the action of at least one balance spring or an alternate elastic return means 7. The intermittent blocking mechanism 6 is pivoted in at least one bottom plate 2.

According to the invention, intermittent blocking mechanism 6 forms an inseparable one-piece component 20 with bottom plate 2.

Preferably, this bottom plate 2 also forms a one-piece component with a first bearing 51 for an escape wheel 5 and with a second pivot bearing 52 for regulating member 4 or of balance 41.

This first bearing 51 and second bearing 52 are remote from each other with a fixed distance between centres thereof.

Intermittent blocking mechanism 6 pivots about a virtual axis 53 whose theoretical position is defined with reference to the positions of first bearing 51 and of second bearing 52.

Preferably, intermittent blocking mechanism 6 includes at least one pallet lever 61 in one-piece with plate 2 to which the pallet lever is connected by elastic return means 65.

In a particular variant, this pallet lever 61 includes a top portion 62 carrying pallet stones, horns and a dart, and which is added and secured to a bottom portion 63 which is in the plane of plate 2. The bottom portion 63 is connected to plate 2 by elastic return means 65 which are also in the plane of plate 2, as seen in FIG. 3.

Figure 3:
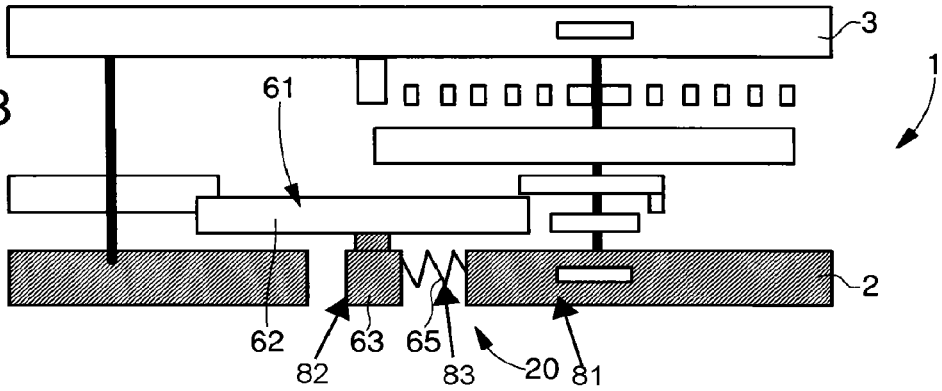
FIG. 3 shows, in a similar manner to FIG. 2, a variant wherein the actual pallet lever is secured to a base of this type.

In the variant of FIG. 3, pallet lever 61 is situated between plate 2 and a bar 3, and includes a top portion 62 carrying pallet stones, horns and a dart in one or more parts and which is in one-piece with a bottom portion 63 and extends thereabove in the direction of bar 3. Bottom part 63 is in the plane of plate 2 to which it is connected by elastic return means 65 which are also in the plane of plate 2.

Figure 2:
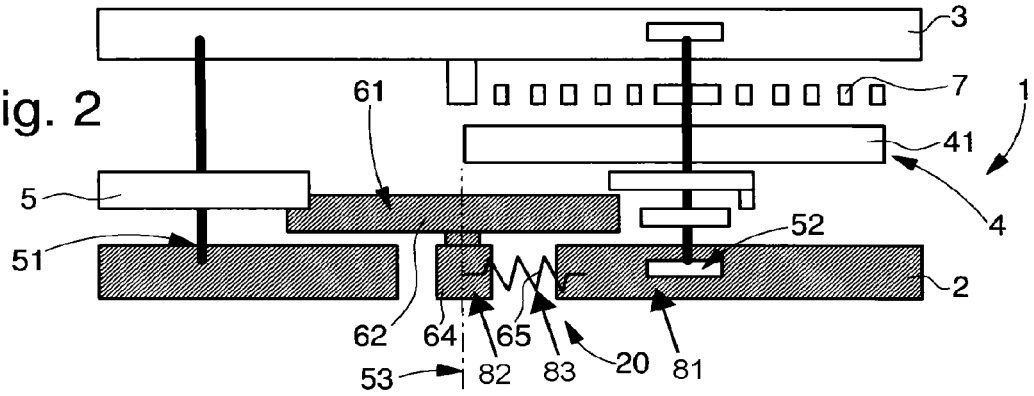
FIG. 2 shows, in a similar manner to FIG. 1, a variant wherein a pallet lever of this type includes a base in the plane of the plate, in addition to said integrated elastic return means.

In the FIG. 2 variant, pallet lever 61 includes a base 64 in the plane of plate 2, in addition to integrated elastic return means 65 which are also in the plane of plate 2. Advantageously, pallet lever 61 is in one-piece with pivot points: in FIG. 2, the shaded component is made in a one-piece manner. Pallet lever 61 is guided on flexible arms 65 connected to a frame/plate. In particular according to the invention, pivot points are added to the frame/plate, in this case that of the escape wheel and that of the balance. The great advantage is that the distance between centres is very precisely defined.

Figure 4:
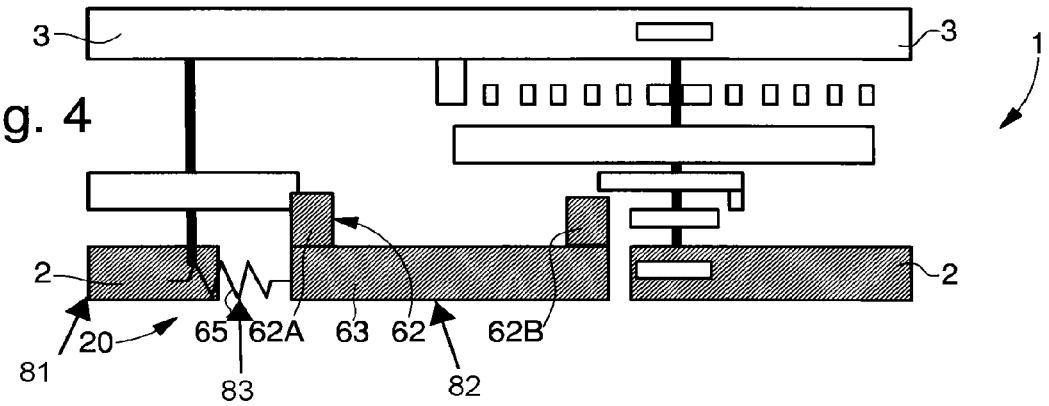
FIG. 4 shows, in a similar manner to FIG. 1, a variant wherein a pallet lever of this type is in the plane of the plate and includes protruding parts, such as the dart, horns and pallet stones, on at least one top level.
Figure 5:
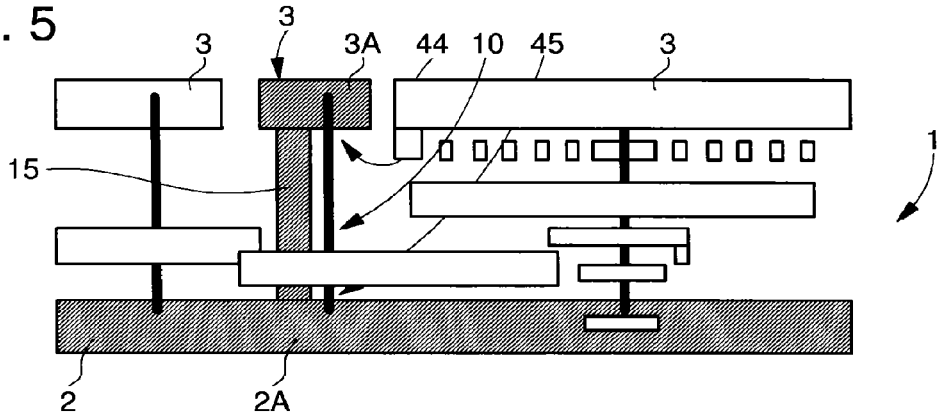
FIG. 5 shows, in a similar manner to FIG. 1, a variant wherein the pallet lever is pivoted at at least one of the ends thereof in the plate, and at the other end thereof in a bearing holder substantially on the level of the bar and connected to the plate by a cross-piece.

Further, although in one-piece, the component is developed on several levels; on two substantially parallel planes in the embodiment of FIG. 2. FIGS. 3 to 5 also illustrate one-piece components with several levels, with three levels in FIG. 5.

In the FIG. 3 variant, the top portion 62 of pallet lever 61 is arranged on a base 63 of this type and top portion 62 is not in one-piece with said base 63.

In the FIG. 4 variant, the pallet lever is in the plane of the plate and includes protruding portions 62A and 62B such as pallet stones and respectively, a dart and horns, on at least one top level.

Advantageously, this inseparable single-piece component 20 includes an integrated elastic return means for performing a function of energy distribution and/or regulation and/or return and/or damping and/or locking in an adjustment position.

In a particular arrangement, advantageous for the function of a pallet lever whose pivoting is not uniform, and which does not convey a uniform quantity of energy, these integrated elastic return means include at least one flexible bistable or multistable element.

Figure 6:
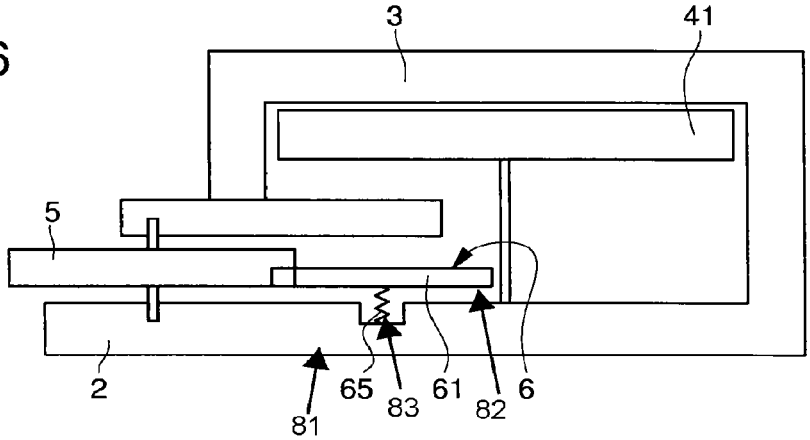
FIG. 6 shows, in a similar manner to FIG. 1, a variant wherein the pallet lever is pivoted within the balance rim.

FIG. 6 illustrates a variant wherein pallet lever 61 is pivoted within the rim of the balance 41 and wherein, preferably, the entire pallet lever moves underneath balance 41.

For the adjustment and storage in position, particularly for pre-adjustment, of at least one of the functional components comprised in mechanism 1, a functional component of this type, in particular pallet lever 61, or a pallet lever base 64, or a bottom portion 63 of a pallet lever, or other element, is position adjustable and can be immobilised in a pre-adjusted position by locking means.

Figure 7:
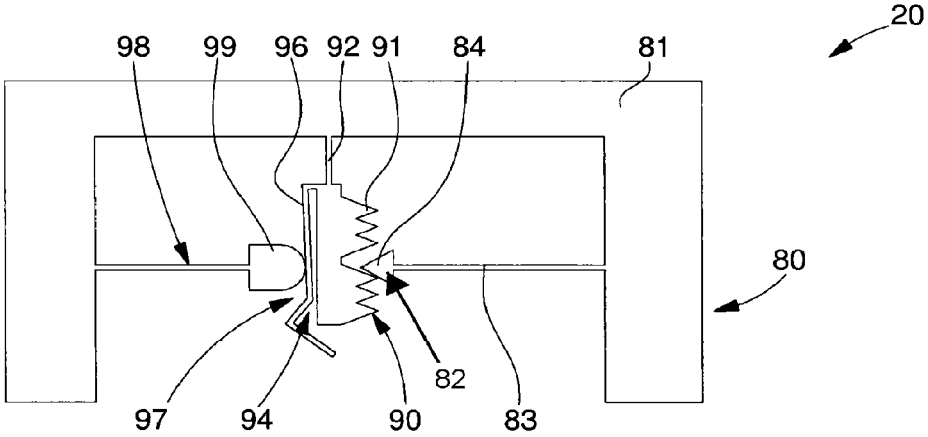
FIG. 7 shows a plan view of a one-piece assembly including a means of adjusting the position of a component which is also integrated in the assembly, said adjustment means being able to be immobilised in position by blocking means; the Figure illustrates the adjustment of an index by elastic adjustment means including a comb, the blocking in position of the comb in an adjusted position, and a locking mechanism controlling the blocking means; the comb immobilises an index located at the end of a flexible strip, the comb being pressed onto said index by a locking strip spring which is in turn immobilised by a locking finger.
Figure 8:
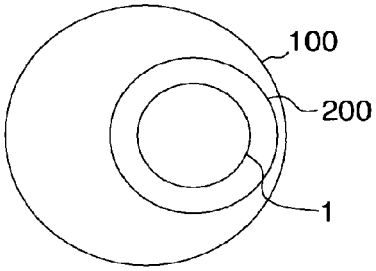
FIG. 8 is a schematic view of a timepiece movement including an escapement mechanism of this type.

FIG. 7 illustrates a one-piece assembly comprising a means of adjusting the position of a component which is also integrated in mechanism 1, said adjustment means being able to be immobilised in position by blocking means.

Thus, in a particular embodiment, at least plate 2 includes a position adjustable mechanism 80 comprising a rigid structure 81 (formed, in particular, by the board of the plate), carrying, via at least one elastic strip 83, a position adjustable component 82. This adjustable component 82 either bears pallet lever 61, or a pallet lever base 64, or a bottom portion of a pallet lever 63. Mechanism 80 includes an indexing means 84 arranged to cooperate with a complementary indexing means 91 comprised in an adjustment mechanism 90. These complementary indexing means 91 are detachably mounted to indexing means 84 and can be blocked in a position of cooperation by a blocking mechanism 94 elastically secured to structure 81.

The blocking mechanism 94 is in turn subjected to the action of a locking mechanism 98 which allows mechanism 94 to occupy either an uncoupled position in which adjustment mechanism 90 is free, or a coupled position in which blocking mechanism 94 hinders adjustment mechanism 90. This locking mechanism is in turn also elastically fixed to structure 81.

Thus, advantageously, at least one inseparable one-piece component 20 includes a position adjustable mechanism 80 including a rigid structure 81. This rigid structure 81, particularly plate 2, carries, via at least one elastic strip 83, a position adjustable component 82 including indexing means 84 arranged to cooperate with complementary indexing means 91 comprised in an adjustment mechanism 90, said complementary indexing means 91 being detachably mounted to indexing means 84 and being blockable in position by a blocking mechanism 94 elastically secured to said structure 81, said blocking mechanism 94 being in turn subjected to the action of a locking mechanism 98 which allows mechanism 94 to occupy either an uncoupled position in which adjustment mechanism 90 is free, or a coupled position in which said blocking mechanism 94 hinders said adjustment mechanism 90, said locking mechanism 98 also being elastically fixed to said structure 81.

This combined adjustment, blocking and locking mechanism is also applicable to a wide variety of applications: positioning a bearing, a stop member or other element.

The design of mechanisms 1 according to the invention including inseparable one-piece components 20 also optimises the pivoting of the various wheel sets and, as required, ensures the parallelism thereof, or conversely permits at least one end of a wheel set arbor to be moved to make a micrometric modification to a setting.

The action on the pivot points permits, in particular, the distance of centres between the wheel sets to be adjusted to adjust the penetration of the toothings and/or pallet stones. The distance between centres can be adjusted in a one-piece manner with the plate or the bar. This principle of adjusting the distance between centres is valid for all the distances between centres in a movement.

In an advantageous embodiment of intermittent blocking mechanism 6 according to the invention, plate 2 is in one-piece with travel limit stops of intermittent blocking mechanism 6. In general, the incorporation of limiting elements, regardless of whether they are in plate 2, bar 3 or another inseparable one-piece component 20, is an advantage of the invention.

In particular, the inseparable one-piece component 20 is made of silicon, and the integrated elastic return means of inseparable one-piece component 20 are pre-stressed in an oxidised silicon state.

In an advantageous embodiment, mechanism 1 is made of silicon. The pivot points are defined, for example, by anisotropic (KOH) etches in a silicon substrate. The great advantage is the very precise positioning of the pivot points (distance from centres, verticality).

The shock absorbers may thus be partially or totally made inside the plate: the shock absorber spring may be made jointly with the plate. One of the two (or both) jewels may be made jointly with the plate. The pivoting then occurs directly in the silicon. The pivot points may be made straight in the silicon with DLC or other surface coatings. There are thus no longer any jewels and the points of rotation are very precisely positioned.

In a particular embodiment, inseparable single-piece component 20 includes severable elements intended to facilitate the assembly of the component in a larger assembly, the severable elements then only need to be broken off to give one or more degrees of freedom to some of its constituent parts.

In an advantageous embodiment of cassette 1 according to the invention, the inseparable single-piece component 20 is made of micromachinable material, or silicon, or silicon oxide, and the integrated elastic returns means of the inseparable single-piece component is pre-stressed in a silicon oxide state. Other materials in MEMS or "LIGA" technology may be employed. Quartz, DLC, at least partially amorphous materials or metallic glasses, may be used for these applications, although the list is not limiting.

A particular structuring of plate 2 and/or bar 3 and/or of inseparable one-piece components 20 may compensate the effects of expansion of these structural elements, or of components of the mechanism of cassette 1. It is, for example, possible to make the plate in silicon, and then oxidise it, for the sake of consistency.

The invention also concerns a timepiece escapement 200 including at least one intermittent blocking mechanism 6 of this type. In a particular embodiment, only the escape wheels and the balance are independent components, the remainder of escapement mechanism 200 forming an inseparable one-piece component 20.

The invention also concerns a mechanical timepiece movement 100 including at least one escapement mechanism 200 of this type.

The invention claimed is:

1. A timepiece assembly comprising:

a bottom plate; and a mechanism for intermittent blocking of at least one escape wheel;

the intermittent blocking mechanism cooperating with at least one regulating member or a balance which is configured to be actuated with an alternate motion under action of at least one balance spring or an alternate elastic return means, the intermittent blocking mechanism being configured to be pivoted in at least the bottom plate, wherein the intermittent blocking mechanism forms an inseparable one-piece component with the bottom plate, which also forms a one-piece component with a first bearing for the escape wheel and with a second pivot bearing for the regulating member or of the balance, the first bearing and the second bearing being remote from each other with a fixed distance between centers thereof, and the intermittent blocking mechanism pivoting about a virtual axis whose theoretical position is defined with reference to positions of the first bearing and the second bearing, wherein the inseparable one-piece component includes a position adjustable mechanism including a rigid structure carrying, via a least one elastic strip, a position adjustable component including indexing means arranged to cooperate with complementary indexing means comprised in an adjustment mechanism, the complementary indexing means being detachably mounted to the indexing means and being blockable in a position of cooperation by a blocking mechanism elastically fixed to the structure, the blocking mechanism being in turn subjected to action of a locking mechanism which allows the blocking mechanism to occupy either an uncoupled position in which the adjustment mechanism is free, or a coupled position in which the blocking mechanism hinders the adjustment mechanism, the locking mechanism also being elastically fixed to the structure.

2. The timepiece assembly according to claim 1, wherein the intermittent blocking mechanism is a pallet lever in one-piece with the plate to which the pallet lever is connected by elastic return means.

3. The timepiece assembly according to claim 2, wherein the pallet lever includes a top portion carrying pallet stones, horns, and a dart, and which is added and secured to a bottom portion, which is in the plane of the plate to which the pallet lever is connected by the elastic return means which is also in the plane of the plate.

4. The timepiece assembly according to claim 2, wherein the pallet lever is situated between the plate and a bar and includes a top portion carrying pallet stones, horns, and a dart in one or more parts, and which is in one-piece with a bottom portion and extends thereabove towards the bar, the bottom portion is in the plane of the plate and is connected thereto by the elastic return means which is also in the plane of the plate.

5. The timepiece assembly according to claim 1, wherein the inseparable one-piece component includes integrated elastic return means for performing a function of energy distribution and/or regulation and/or return and/or damping and/or blocking in an adjustment position.

6. The timepiece assembly according to claim 5, wherein the integrated return means includes at least one flexible bistable or multistable element.

7. The timepiece assembly according to claim 1, wherein the inseparable one-piece component is made of silicon, and the integrated elastic return means of the inseparable one-piece component is pre-stressed in an oxidized state of the silicon.

8. An escapement mechanism comprising at least one timepiece assembly according to claim 1.

9. A mechanical timepiece movement comprising at least one escapement mechanism according to claim 8.

* * * * *